US005406305A

United States Patent [19]

Shimomura et al.

[11] Patent Number: 5,406,305

[45] Date of Patent: Apr. 11, 1995

[54] DISPLAY DEVICE

[75] Inventors: Youko Shimomura, Moriguchi; Tetsuji Takeuchi, Tsuzuki; Teruaki Shigeta, Neyagawa, all of Japan

[73] Assignee: Matsushita Electric Industrial Co., Ltd., Osaka, Japan

[21] Appl. No.: 182,569

[22] Filed: Jan. 18, 1994

[30] Foreign Application Priority Data

Jan. 19, 1993 [JP] Japan ..... 5-006301

[51] Int. Cl.[6] ..... G09G 3/36

[52] U.S. Cl. ..... 345/102; 345/63

[58] Field of Search ..... 345/102, 63; 348/602, 348/603

[56] References Cited

U.S. PATENT DOCUMENTS

| | | | |
|---|---|---|---|
| 3,027,421 | 3/1962 | Heijligers | 348/602 |
| 4,511,921 | 4/1985 | Harlan | 348/602 |
| 4,572,646 | 2/1986 | Shimizu et al. . | |
| 4,589,022 | 5/1986 | Prince | 348/602 |
| 5,057,744 | 10/1991 | Barbier | 348/602 |

FOREIGN PATENT DOCUMENTS

| | | | |
|---|---|---|---|
| 4-20924 | 1/1992 | Japan . | |
| 4006589 | 1/1992 | Japan | 345/63 |
| 4-75321 | 7/1992 | Japan . | |
| 4344692 | 12/1992 | Japan | 345/63 |

OTHER PUBLICATIONS

Rushton, "Kinetics of Cone Pigments Measured Objectively on the Living Human Fovea", *Annals of New York Academy of Science*, vol. 74, pp. 291–304, (1958).

*IES Lighting Handbook*, 1984 Reference Volume, pp. 3-12-3-21.

*Primary Examiner*—Alvin E. Oberley
*Assistant Examiner*—Minsun Oh
*Attorney, Agent, or Firm*—Wenderoth, Lind & Ponack

[57] ABSTRACT

A display device includes an ambient light sensor positioned adjacent a display screen so as to confront an occupant in front of the display device, and a luminance level setting unit for inputting a desired luminance level. An output from the ambient light sensor is fed to a screen luminance calculating unit for calculating the adjustable range of screen luminance to be adjusted on the basis of an output signal from the ambient light sensor. A luminance determining unit determines a proper screen luminance based on an output signal from the screen luminance calculating unit and an output signal from the luminance level setting unit. A screen luminance control unit operates in response to an output signal from the luminance determining unit to adjust the screen luminance to the proper screen luminance.

6 Claims, 6 Drawing Sheets

DISPLAY DEVICE

BACKGROUND OF THE INVENTION

1. Field of the Invention

The present invention generally relates to a display device and, more particularly, to a display having a capability of automatically controlling the luminance at the screen in response to a change in intensity of ambient light falling on the screen so that displayed information such as characters, images or a combination thereof may be clearly viewed regardless of the ambient brightness or illuminance.

2. Description of the Prior Art

A display device used as an output terminal device of a personal computer, a word-processor or an engineering work station can be found not only in houses, but also in offices. This type of display device makes use of a display unit such as, for example, a cathode ray tube (CRT), a liquid crystal display (LCD) panel, a plasma display panel (PDP) or an electro-luminescent (EL) display panel. The display unit includes a multiplicity of pixels arranged in a matrix pattern to provide a display screen.

Most of the currently available display devices is provided with either an adjustment switch having a plurality of switch positions for intermittently changing the luminance of the display screen or an adjustment knob for progressively changing the luminance of the display screen, so that the operator or user can adjust the luminance of the display screen to render it consistent with the ambient brightness, that is, the intensity of ambient light falling on the display screen.

In either case, in an environment where the ambient light frequently changes, the adjustment of the luminance of the display screen is indeed cumbersome and is often sunk into oblivion. Also, depending on the position of the operator or user, the luminance adjustment may often be time-consuming and good for nothing.

To alleviate those inconveniences, publications such as, for example, the Japanese Laid-open Patent Publication No. 4-20924 and the Japanese Laid-open Utility Model Publication No. 4-75321 disclose the use of an ambient light sensor installed at the front of the display screen to detect the intensity of ambient light falling on the display screen so that an output from the ambient light sensor can be utilized to adjust the luminance of the display screen.

FIG. 6 illustrates, in a block diagram, the principle of the prior art display device disclosed in the first mentioned Japanese publication. Referring to FIG. 6, the prior art display device comprises a liquid crystal panel 1 and a back-lighting panel 3 electrically coupled with a back-light source 4 and positioned parallel to and on one side of the liquid crystal panel 1 opposite to the position of an operator or user (not show, but occupying a left-hand side of the drawing). This prior art display device also comprises an ambient light sensor 2 including an illuminance meter and positioned on one side of the liquid crystal panel 1 opposite to the position of the operator or user for detecting the intensity of ambient light having passed through the liquid crystal panel 1, and a processor 5 operable in response to an output from the ambient light sensor 2 to control the back-light source 4.

According to the prior art display device shown in FIG. 6, the ambient light sensor 2 provides an output S indicative of the intensity of ambient light falling on the liquid crystal panel 1 to the processor 5 which in turn controls the voltage to be applied to the back-light source 4 to adjust the luminance of the back-light source 4 to a value appropriate to the ambient brightness.

The automatic luminance adjustment such as practiced in the prior art display devices is so designed as to minimize a limited amount of electric power and to increase the lifetime of the back-light source. By way of example, in the case of the prior art display device shown in and described with reference to FIG. 6, by lowering the luminance of the back-light source if the ambient illuminance is sufficiently high, the lifetime of the back-light source can be increased.

In any event, the prior art automatic luminance adjustment is such that, when the ambient brightness around the display device is relatively high or low, the luminance of the back-light source is reduced or increased, respectively. This technique is not necessarily consistent with characteristics of human vision.

More specifically, although both an increase in the lifetime of the back-light source and an energy-saving are successfully accomplished, the prior art display device still has a problem in that for a particular operator or user the luminance of the display screen may become either too low to discern the displayed information such as characters, images or a combination thereof, or too high so as to cause glare. This problem often leads to a reduction in work efficiency, asthenopia and/or a sensation of mental fatigue.

SUMMARY OF THE INVENTION

Accordingly, the present invention is intended to provide an improved display device wherein, by controlling the luminance of the display screen in reference to a change in ambient brightness, a visibility consistent with a change in characteristic of human eyes is secured.

To this end, the present invention provides a display device which comprises an ambient light sensor positioned adjacent a display screen so as to confront an occupant in front of the display device, a screen luminance calculating unit for calculating the adjustable range of screen luminance to be adjusted on the basis of an output signal from the ambient light sensor, a luminance level setting unit for inputting a desired luminance level, a luminance determining unit for determining a proper screen luminance based on an output signal from the screen luminance calculating unit and an output signal from the luminance level setting unit, and a screen luminance control unit operable in response to an output signal from the luminance determining unit to adjust the screen luminance to the proper screen luminance.

Preferably, the luminance determining units calculates the adjustable range of screen luminance L so as to satisfy the following relationship with the ambient illuminance I detected by the ambient light sensor including an illuminance meter:

$$18 \cdot I^{0.139} \leqq L \leqq 53 \cdot I^{0.113} \quad (1)$$

Preferably, the display device of the present invention may also comprises a threshold luminance calculating unit adapted to receive the output signal indicative of the ambient illuminance I, that is fed from the ambient light sensor, to determine a maximum acceptable screen luminance which is acceptable to avoid a glaring sensation (or discomfort glare). This threshold luminance calculating unit provides the luminance determining unit with an output signal indicative of the maximum acceptable screen luminance.

The threshold luminance calculating means referred to above calculates the maximum acceptable screen luminance $L_{lim}$ so as to satisfy the following relationship with the ambient illuminance I detected by the ambient light sensor including the illuminance meter:

$$L_{lim}=14.5\cdot I^{0.434} \quad (2)$$

Also, the luminance determining unit may be so designed as to receive the output signal from the screen luminance calculating unit, which is indicative of the adjustable range of screen luminance L, and an output from the threshold luminance calculating means which is indicative of the maximum acceptable screen luminance $L_{lim}$, so that the adjustable range of screen luminance L may be limited by the maximum acceptable screen luminance $L_{lim}$ in the event that the maximum acceptable screen luminance is lower than an upper limit of the adjustable range of screen luminance L.

Thus, according to the present invention, the intensity of ambient light falling on the display screen is detected by the ambient light sensor so that the luminance of the display screen can be adjusted in reference to the detected intensity of ambient light to secure a favorable visibility. The adjustable range of screen" luminance L falling within the specific range is necessary for the display screen to provide a satisfactory viewability acceptable to human eyes. Moreover, in consideration of the visibility of human eyes, the threshold screen luminance is provided to avoid the glaring sensation (or discomfort glare) which the user or operator may have when looking at the display screen.

BRIEF DESCRIPTION OF THE DRAWINGS

This and other objects and features of the present invention will become clear from the following description taken in conjunction with preferred embodiments thereof with reference to the accompanying drawings, in which like parts are designated by like reference numerals and in which.

DETAILED DESCRIPTION OF THE EMBODIMENTS

Figure 1:
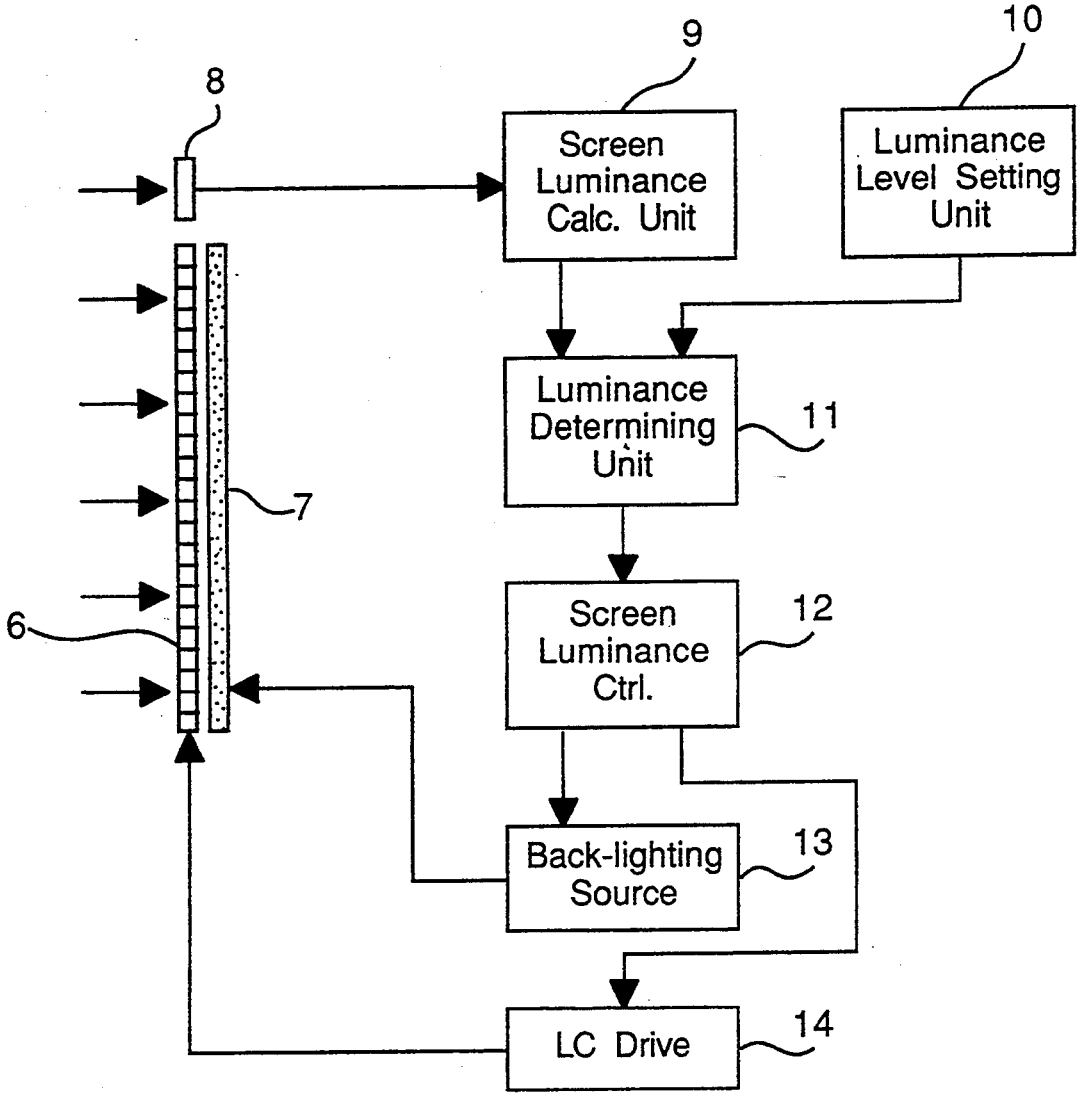
FIG. 1 is a schematic circuit block diagram showing a control unit employed in a display device according to the present invention.

Referring first to FIG. 1, the illustrated display device includes a display screen 6 comprised of a transmissive liquid crystal panel, a back-lighting lamp 7 disposed rearwardly of the display screen with respect to the position of an operator (not shown) for lighting the display screen 6 from behind, and an ambient light sensor 8, including an illuminance meter, for detecting the illuminance at the display screen 6, that is, the intensity of ambient light falling on the display screen 6. The ambient light sensor 8 including the illuminance meter may comprise a silicon photodiode having a light receiving surface of a sensitivity adjusted to permit it to provide an output signal consistent with or proportional to the illuminance at the display screen 6, and an amplifier for amplifying the output signal from the silicon photodiode. Although the position at which the ambient light sensor 6 is installed may vary depending on the construction of the display device, particularly that of a display unit including the display screen 6, the ambient light sensor 8 is preferably so positioned and so supported as to permit it to detect the illuminance corresponding to the amount of light perceived by the operator.

The ambient light sensor 8 has a time constant chosen to be within the range of 10 to 1,000 seconds. This selection of the time constant of the ambient light sensor 8 is based on a generally accepted notion that the adaption characteristic of the human eyes is about 130 seconds (See, for example, Rushton (1958), Annual of New York Academy of Science, Vol. 74, p291–304). Therefore, if the time constant of the ambient light sensor 8 is greater than the uppermost limit of 1,000 seconds, no effect which the present invention would bring about can be expected, but if the time constant of the ambient light sensor 6 is smaller then the lowermost limit of 10 seconds, flickering would be perceived as occurring on the display in order for the eyes to sensibly pursue a delicate change in the ambient light.

The display device shown in FIG. 1 also comprises a screen luminance calculating unit 9 adapted to receive the output signal from the ambient light sensor 6 and to calculate the adjustable range of screen luminance of the display screen 6 on the basis of a preset function or algorithm stored therein, and a luminance level setting unit 10 including an adjustment knob or button accessible to the operator for inputting a desired screen luminance. Preferably, the adjustment knob or button of this luminance level setting unit 10 has three selectable positions; an average level position, a higher level position and a lower level position, to provide a freedom of choice to the operator and, hence, the luminance level setting unit 10 is so designed as to provide an identical output signal indicative of one of the levels chosen unless another one of the levels is chosen by the operator.

The display device furthermore comprises a luminance determining unit 11 for determining a proper screen luminance based on the output signal from the screen luminance calculating unit 9 and the output signal from the luminance level setting unit 10, a screen luminance control unit 12 for controlling the display screen 6 and the intensity of light emitted by the back-lighting lamp 7 (the luminance of the back-lighting lamp 7) on the basis of a determination rendered by the luminance determining unit 11, a back-lighting power source 13 operable to supply electric power to the back-lighting lamp 7 and also operable in response to an output signal from the screen luminance control unit 12 to adjust the luminance of the back-lighting lamp 7, and a liquid crystal (LC) drive unit 14 for driving the liquid crystal display panel forming the display screen 6 and also for adjusting the light transmissivity of the liquid crystal panel.

The operation of the display device of the above described construction will now be described.

Figure 2:
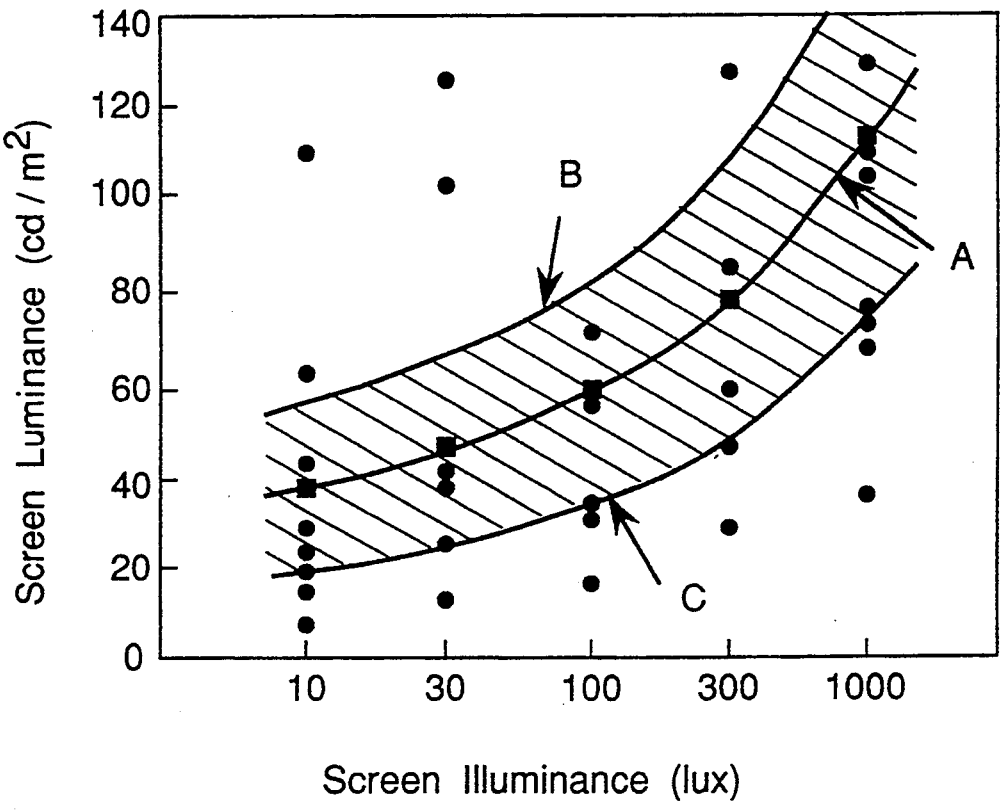
FIG. 2 is a graph showing the relationship between the illuminance at the display screen and the adjusted luminance of the display screen, illustrating a basic concept of the display device shown in FIG. 1.

FIG. 2 illustrates the relationship between the screen illuminance, which provides a basic concept of the function stored in the screen luminance calculating unit 9, and the adjusted screen luminance necessary to secure the visibility, which relationship is determined experimentally and theoretically.

Figure 3:
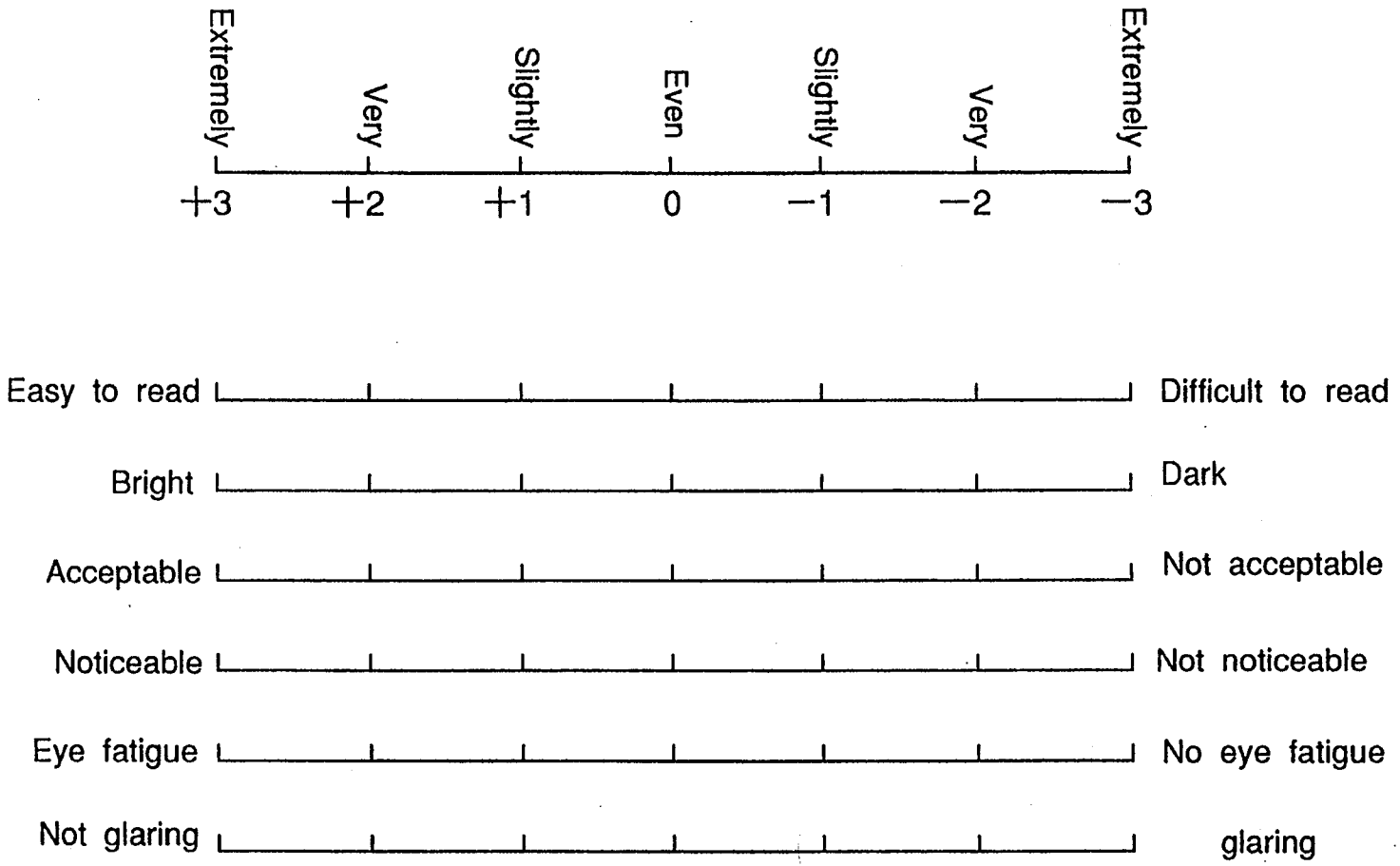
FIG. 3 is a chart showing test items used in a subjective evaluation test to assess the basic concept of the present invention.

The experiment was carried out by presenting to individual panelists display screens reproducing characters and set to 10, 20, 40, 80 and 160 cd/cm$^2$ (candela per square meter) in screen luminance under the screen illuminance of 10, 30, 100, 300 and 100 lx (lux). The panelists were allowed to evaluate the displayed information subjectively and then to check-mark respective scales under test items of ease of reading, brightness, preference, conspicuousness, degree of eye fatigue and glare as shown in FIG. 3. At the same time, using the adjustment technique, the screen luminance which the panelists considered optimum was determined. This was carried out to determine the optimum screen luminance, at which the panelists felt comfortable in reading the display information, using the adjustment technique in combination with the subjective evaluation.

During the experiment, for the adjustable range of illuminance under which display devices are actually used in practice, five lighting conditions of 10, 30, 100, 300 and 1,000 lx (lux) were chosen. On the other hand, for the adjustable range of screen luminance, five luminance conditions of 10, 20, 40, 80 and 160 cd/m$^2$ were chosen to create simulated situations in which the displayed information is slightly difficult to discern under a dark environment, the displayed information is sufficiently easy to discern under a bright environment and the displayed information is glaring under a relatively dark environment. The panelists consisted of 7 males and 2 females, ranging in age from 24 to 49 and having experience in VDT jobs.

At the outset of the experiment, the panelists were requested to read sentences excerpted from a popular book, "Shomen (Lighting)" (Akarino Hyakka, edited and published by Matsushita Denki Shomei Kenkyusho and Toyo Keizai Shinpo-sha) which was reproduced on the display screen at each screen luminance under each lighting condition. The panelists were requested to view the display information presented immediately before they started reading the reproduced sentences and then adjusted the luminance of the display screen to the optimum value determined according to the subjective evaluation on the test items shown in FIG. 3 and the adjustment technique. Then, after the panelists had been allowed to read the reproduced sentences for a period of 5 minutes, the panelists were again requested to evaluate the test items of FIG. 3, and the adjustment to the optimum screen luminance was performed again.

For the purpose of the present invention, various results of evaluation and data were analyzed after the reading was carried out. This is because, in general, the evaluation given when the display is first viewed and that given after the display has been viewed does not always match with each other and, hence, the evaluation given after a period of viewing appears to be proper for the evaluation of the display.

The SD technique used as the above discussed subjective evaluation method is a method of measuring a meaning devised by an American psychologist, C. E. Osgood, in the 1950's as a psychological standard for the objective and quantitative measurement of emotional meanings which are a kind of internal meaning. This evaluation method is often used in evaluating the image quality, and the test items shown in FIG. 3 are six items, selected from a number of test items used in past experiments (for example, Report concerning research on new office systems, published in 1991 by a non-profit organization, Nippon Denshi Kogyo Shinko Kyokai (Industry Promoting Association of Japan)), since those six test items appear to have been suitable in evaluating the viewability of the displayed information. As shown in FIG. 3, each test item is so designed as to have seven levels to be selectively check-marked by the panelist to suit to what he or she has in mind.

The adjustment technique referred to above is the oldest method of all psychophysical methods and yet the most fundamental. This is a technique of determining psychological constants such as area (the threshold value at which the stimulus or a difference in stimulus can be perceived), subjective equivalent value (the amount of stimulus at which a given stimulus is perceived as equal to a control stimulus) and extreme value (the amount of stimulus at which the subject being tested considers the best and the worst) while the subject being tested varies the stimulus arbitrarily. (See, for example, Psychometric Methods (1954), J. P. Guilford McGraw-Hill Book Company Inc., N.Y.) In view of these, both of the techniques discussed above appear to be effectively utilized in evaluating the display information on the display screen.

The relationship between the screen illuminance, which provides a basic concept of the function stored in the screen luminance calculating unit 9, and the adjusted screen luminance, which has been obtained as a result of the foregoing experiments, will now be described. In FIG. 2, ● denotes the screen luminance obtained, at each of the five illuminance levels, by the adjustment technique in which each panelist was allowed to adjust the screen luminance, and ■ denotes the average value of the screen luminances adjusted by the respective panelists at each of the five illuminance levels. A curve A is the one that is drawn to connect the average values of the screen luminances at the respective illuminance levels. A hatched area delimited between A curve B, representative of the uppermost limit of the screen luminance, and curve C representative of the lowermost limit of the screen luminance is so chosen and so defined that, assuming that the maximum rating in ease of reading can be given at the screen luminance obtained during the test using the adjustment technique, the screen luminance at each screen illuminance falls within an allowance of ±50% at each screen illuminance level and, at the same time, three fourths or more of the maximum ratings in ease of reading can be obtained at each of the screen illuminance levels during the test using the SD technique.

Thus, if the screen illuminance is 10 lx, 100 lx or 1,000 lx, the screen luminance reads 40±20, 60±25 and 115±40 cd/m$^2$, respectively. Accordingly, a satisfactory viewability can be obtained if the display screen under a particular lighting condition, i.e., at a particular screen illuminance, is adjusted to a screen luminance falling within the hatched area bound by the curves B and C.

Where the screen luminance is to be automatically adjusted, the sensitivity of the human eyes must be taken into consideration, and the viewability is currently qualitatively evaluated in terms of visibility V1. The visibility V1 is a qualitative parameter indicative of the viewability of an object being viewed.

The visibility V1 is qualitatively expressed in terms of the multiplicity of the ratio C between the luminance of an object being viewed and that of the background relative to the ratio (referred to as a luminance/ratio discriminating area $C_{min}$) of the minimum luminance at which the human eyes can discern under a particular environment in which an object is viewed.

This visibility V1 is defined by the ratio ($C/C_{min}$) of the contrast C of the object being viewed relative to the background thereof to the critical value $C_{min}$ of the contrast at which the object can be discerned. In this case, the contrast C can be expressed by the following equation, in which the luminance of the object is expressed by Lo, the background luminance is expressed by Lb, and the equivalent luminance Leq in which the light reflected from the object and subsequently scattered within the eyeballs is taken into consideration:

$$C = |Lb - Lo| / (Leq + Lb) \quad (3)$$

The relationship between $C_{min}$ and Lb, such a standard characteristic of human eyes as expressed by the following equation is reported by the International Lighting Committee:

$$C_{min} = 0.05936\{(1.639/Lb)^{0.4} + 1\}^{2.5} \quad (4)$$

Accordingly, the visibility V1 can be expressed by the following equation:

$$V1 = 16.846\{(1.639/Lb)^{0.4} + 1\}^{2.5} \times C \quad (5)$$

By way of example, the equations (3), (4) and (5) are illustrated in Chapter 3 of IES Lighting Handbook, 1984, Reference Volume).

Calculating the visibility V1 in consideration of various display conditions obtained by the adjustment technique, it will be seen that the visibility V1 takes a substantially constant value (7 to 10) at any illuminance level.

In view of the foregoing, by effecting a light adjustment so as to fall within the hatched area bound between the curves B and C shown in FIG. 2, it is possible to secure a certain viewability and it is also possible to take into consideration the difference in preference resulting from this light adjustment.

Moreover, the display luminance L falling within the hatched area shown in FIG. 2 can be expressed in terms of the illuminance I as shown by the following, but previously discussed, equation (1):

$$18 \cdot I^{0.139} \leq L \leq 53 \cdot I^{0.113} \quad (1)$$

Accordingly, the screen luminance calculating unit 9 stores the function (1) as the adjustable range of screen luminance so that a proper amount of light can be selected.

The display device according to another preferred embodiment of the present invention will now be described with particular reference to FIG. 4. In this embodiment of the present invention, the display device differs from that shown in FIG. 1 in that, as shown in FIG. 4, a critical (or threshold) luminance calculating unit 15 is added and the luminance determining unit identified by 11 is adapted to receive respective output signals from the screen luminance calculating unit 9, the critical luminance calculating unit 15 and the luminance level setting unit 10.

Figure 4:
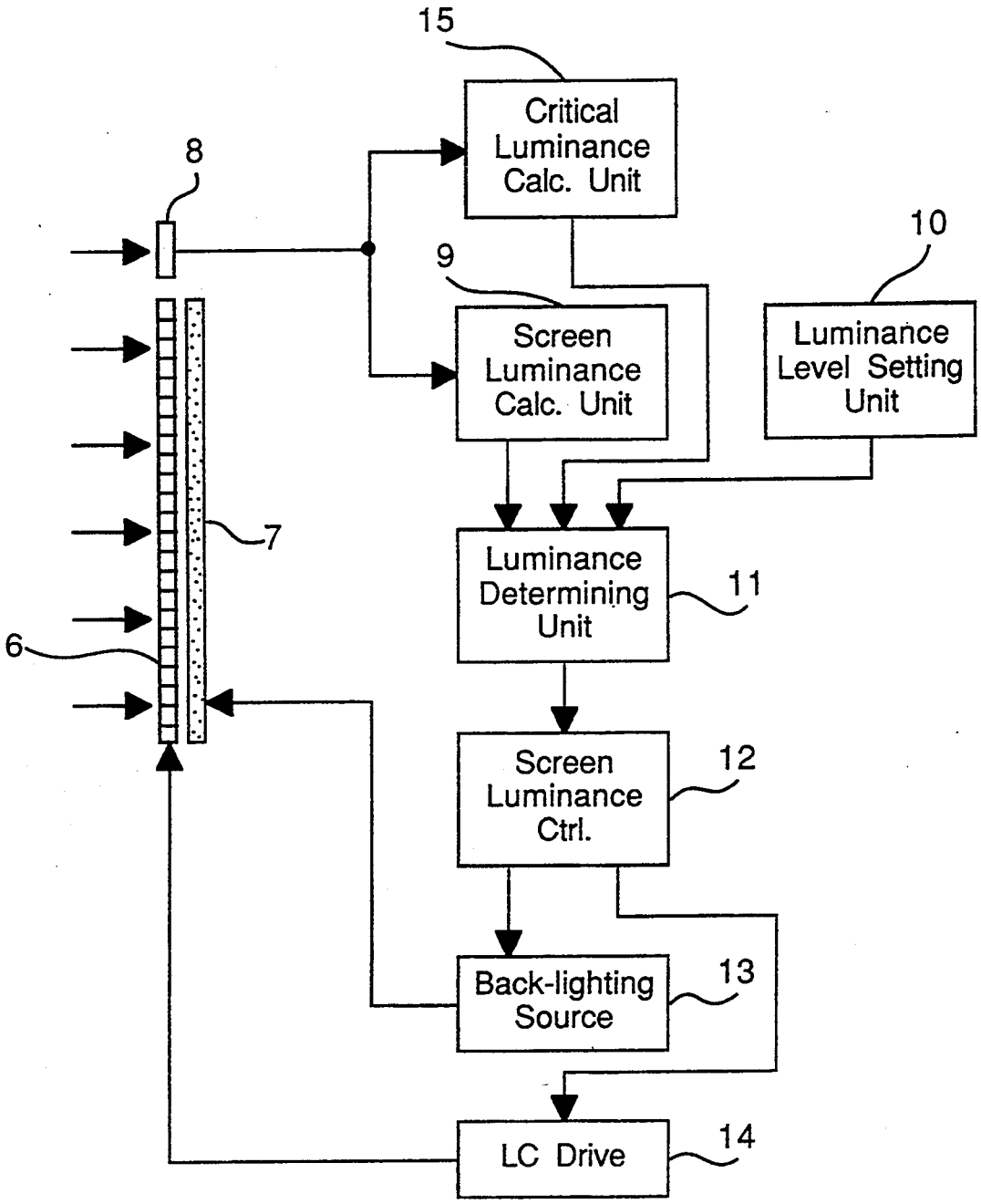
FIG. 4 is a schematic circuit block diagram showing the control unit employed in the display device according to another embodiment of the present invention.

In the circuit arrangement shown in FIG. 4, the output signal from the ambient light sensor 8 representing the screen illuminance is supplied in part to the screen luminance calculating unit 9 and in part to the critical luminance calculating unit 15. The critical luminance unit 15 is operable to calculate the degree of glare occurring in the display screen 6 and the critical luminance and provides an output signal to the luminance determining unit 11.

Figure 5:
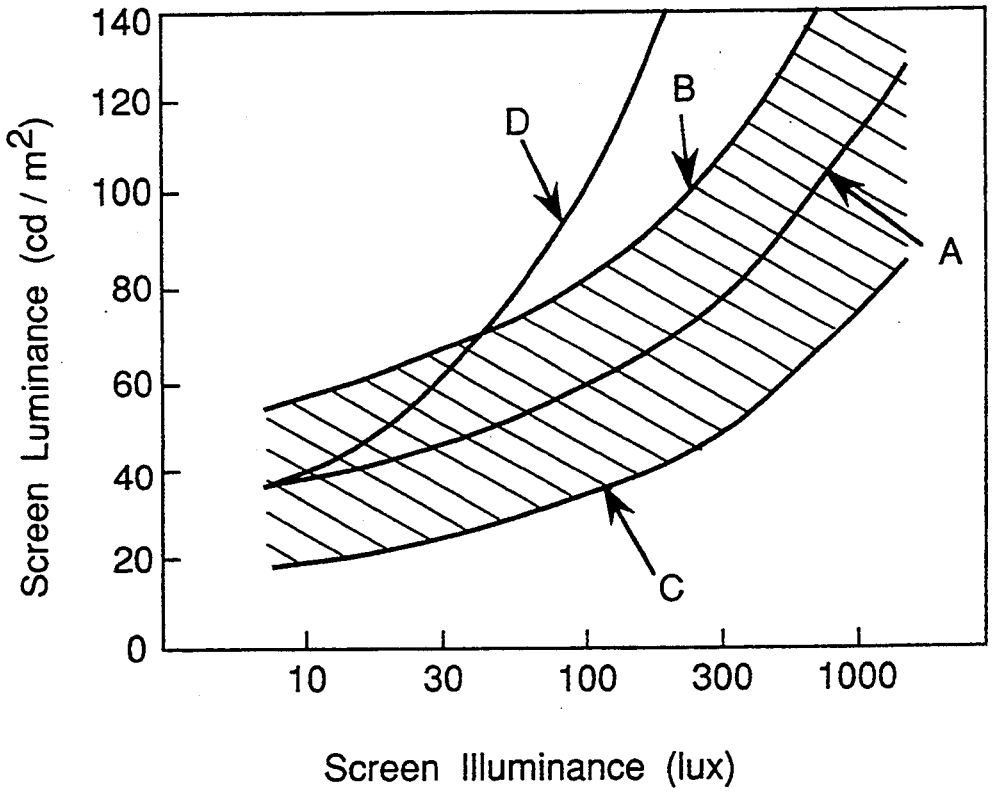
FIG. 5 is a graph showing the relationship between the illuminance at the display screen and the adjusted luminance of the display screen, illustrating a basic concept of the display device shown in FIG. 4.
Figure 6:
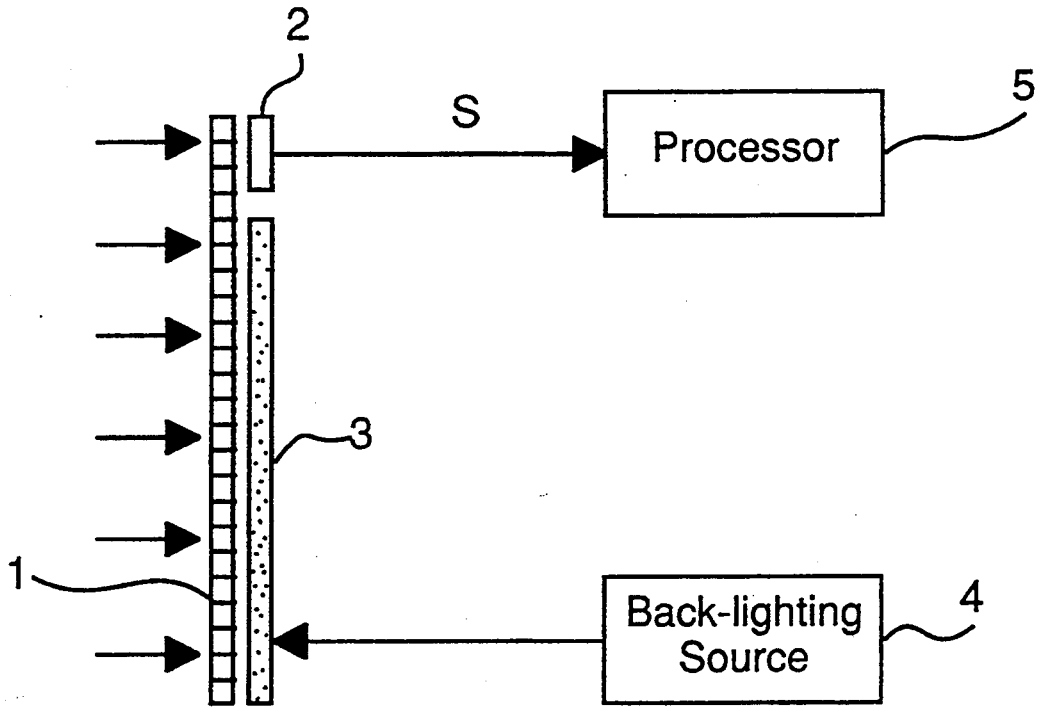
Fig.6 PRIOR ART
FIG. 6 is a schematic circuit block diagram showing the control unit employed in the prior art display device.

A curve D shown in FIG. 5 illustrates the relationship between the screen illuminance, which provides a basic concept of the function stored in the critical luminance calculating unit 15, and the screen luminance adjusted to minimize the glare. Hitherto, no measure has been developed to evaluate the degree of glare occurring in the display device used as an output terminal of a personal computer, a word-processor or an engineering work station. For this reason, the curve D shown in FIG. 5 is determined on the basis of the result of the previously discussed experiment to show an allowable limit of the screen critical luminance at which no glare is perceived, which limit is taken from the zero rating in subjective evaluation. It is to be noted that the curves A, B and C shown in FIG. 5 are identical with those shown in FIG. 2 and no detail is therefore reiterated. Based on a functional relationship expressed by the curve D, the critical luminance calculating unit 15 outputs a signal indicative of the limit of screen luminance at which no glare is perceived. If the critical screen luminance $L_{lim}$ can be expressed by the following equation wherein I represents the illuminance:

$$L_{lim} = 14.5 \exp(\log I) \quad (6)$$

Accordingly, the function (2) referred to above is stored in the critical luminance calculating unit 15 as the critical screen luminance so that the uppermost limit of the adjustable range of light adjustment can be calculated.

Hereinafter the operation of the luminance determining unit 11 according to an embodiment of the present invention will be discussed. As can be understood from FIG. 5, in an environment in which the screen illuminance level is relatively high, for example, 300 lx or higher, no glare problems occur even though the screen luminance is high at 160 cd/m$^2$ and, therefore, the adjustable range of screen luminance over which the screen luminance can be adjusted, which is calculated in the screen luminance calculating unit 9, can be employed unconditionally. However, in the environment in which the screen illuminance is of a low level, for example, 38 lx or lower, it has been found that there is a screen illuminance level at which glare may be perceived, within the adjustable range of screen luminance chosen to secure the viewability. Therefore, the range of light adjustment to be made to the display screen should be such that, if the critical screen luminance calculated by the critical luminance calculating unit 15 is lower than the uppermost limit of the adjustable screen luminance calculated by the screen luminance calculating unit 9, the critical screen luminance is employed as the uppermost limit of the adjustable range of screen luminance. For this purpose, this operation is added to the luminance determining unit 11 so that the display screen substantially is free from discomfort glare while providing a consistent viewability for a given display regardless of the brightness around the display device.

As hereinabove described, with the display device according to the present invention, the screen luminance can be automatically adjusted under various ambient lighting conditions and, therefore, it is possible to provide a display of illegible characters and/or images comfortable to view, thereby contributing to an increase in work efficiency while minimizing the possibility of eye fatigue.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A display device which comprises:

a display screen;

an ambient light sensor positioned adjacent said display screen so as to confront an occupant in front of said display screen;

a screen luminance calculating unit for calculating an adjustable range of screen luminance to be adjusted on the basis of an output signal from said ambient light sensor;

a luminance level setting unit for inputting a desired luminance level;

a luminance determining unit for determining a proper screen luminance based on an output signal from said screen luminance calculating unit and an output signal from said luminance level setting unit;

a screen luminance control unit operable in response to an output signal from said luminance determining unit to adjust the screen luminance so that a visibility level, which is a ratio of a contrast of an object on said display screen against a screen background to a minimum threshold contrast at which said object is discernible to the occupant, is within a predetermined range, the contrast of the object being determined based on an equivalent screen luminance which represents an amount of ambient light reflected from the object on the screen and subsequently scattered within eyeballs of the occupant;

wherein said ambient light sensor includes an illuminance meter and detects an ambient illuminance I; and wherein said luminance determining unit calculates the adjustable range of screen luminance L so as to satisfy the following relationship:

$$18 \cdot I^{0.139} \leqq L \leqq 53 \cdot I^{0.113}.$$

2. The display device as claimed in claim 1, wherein said ambient light sensor detects an ambient illuminance I and outputs a signal indicative thereof; and a threshold luminance calculating unit is provided to receive the output signal indicative of the ambient illuminance I from said ambient light sensor, to determine a maximum acceptable screen luminance which is acceptable to avoid a discomfort glare, and to provide said luminance determining unit with an output signal indicative of the maximum acceptable screen luminance.

3. The display device as claimed in claim 2, wherein said luminance determining unit receives an output signal indicative of the adjustable range of screen luminance L from said screen luminance calculating unit, and an output indicative of the maximum acceptable screen luminance $L_{lim}$ from said threshold luminance calculating unit, so that the adjustable range of screen luminance L is limited by the maximum acceptable screen luminance $L_{lim}$ in the event that the maximum acceptable screen luminance is lower than an uppermost limit of the adjustable range of screen luminance L.

4. The display device as claimed in claim 3, wherein said ambient light sensor includes an illuminance meter; and said threshold luminance calculating unit calculates the maximum acceptable screen luminance $L_{lim}$ so as to satisfy the following relationship:

$$L_{lim} = 14.5 \cdot I^{0.434}.$$

5. The display device as claimed in claim 1, wherein said screen luminance control unit is operable to adjust the screen luminance so that said visibility is in the range of 7 to 10.

6. The display device as claimed in claim 5, wherein the contrast C of the object on said display screen is based on the equivalent screen luminance Leq in accordance with the following equation:

$$C = |Lb - Lo| / (Leq + Lb),$$

where Lo is a luminance of the object on the screen and Lb is a luminance of the screen background.

* * * * *